United States Patent [19]

Sorenson

[11] 4,207,886

[45] Jun. 17, 1980

[54] LADDER ADJUSTING AND STABILIZING APPARATUS

[76] Inventor: Virgil H. Sorenson, P.O. Box 198, Staffordville, Conn. 06077

[21] Appl. No.: 29,971

[22] Filed: Apr. 13, 1979

[51] Int. Cl.[2] ..... E06C 1/04; E06C 5/36

[52] U.S. Cl. ..... 182/172; 182/204

[58] Field of Search ..... 182/172, 204, 205, 107, 182/108, 201

[56] References Cited

U.S. PATENT DOCUMENTS

| | | | |
|---|---|---|---|
| 3,012,628 | 12/1961 | Zumbaum | 182/172 |
| 3,508,628 | 4/1970 | Conrad | 182/172 |
| 3,933,221 | 1/1976 | Sorenson | 182/172 |
| 4,147,231 | 4/1979 | Chantler | 182/107 |

*Primary Examiner*—Reinaldo P. Machado
*Attorney, Agent, or Firm*—Clarence A. O'Brien; Harvey B. Jacobson; Clarence A. O'Brien

[57] ABSTRACT

A pair of elongated stabilizing supports and a pair of mounts for support by opposite side rails of the ladder. The stabilizing supports each include a pair of generally parallel arms and have a first pair of end portions free of connections extending therebetween and connecting structure extending between and connecting the second pair of end portions thereof. Support structure mounts the stabilizing supports from the mounts in upwardly convergent positions with the first pair of end portions uppermost and for lengthwise adjustable shifting of the stabilizing supports relative to the mounts. The first pair of end portions of the stabilizing supports, when the latter are in upper adjusted positions thereof, embracingly receive the corresponding ladder side rails therebetween. The support structure includes support portions from and relative to which the stabilizing supports are lengthwise adjustably shiftable and the support portions are mounted on the mounts for angular displacement about generally parallel axes at least substantially normal to a plane containing the side rails of the ladder.

15 Claims, 7 Drawing Figures

LADDER ADJUSTING AND STABILIZING APPARATUS

BACKGROUND OF THE INVENTION

The ladder stabilizing structure of the instant invention comprises an improvement over the ladder adjusting and stabilizing apparatus disclosed in my prior U.S. Pat. No. 3,933,221, issued Jan. 20, 1976. The stabilizing structure of the instant invention is constructed in a manner whereby it may be more readily attached to an existing ladder and in a manner whereby a greater range of adjustment of the stabilizing structure and greater stabilizing effect on the associated ladder is provided. Further, the stabilizing structure is constructed in a manner whereby it may be more readily telescoped and folded into a fully collapsed position.

BRIEF DESCRIPTION OF THE INVENTION

The ladder stabilizing structure of the instant invention may be mounted on an aluminum or similar ladder equipped with tubular rungs in a manner such that no permanent alterations of the ladder is required. Further, the stabilizing structure may be readily transferred from one ladder to another and is constructed in a manner whereby the lower ends of the downwardly divergent stabilizing arms portions thereof may be readily secured to various different types of surfaces.

It is also pointed out that the stabilizing structure of the instant invention is constructed in a manner whereby an increased range of adjustment over the stabilizing apparatus disclosed in my prior patent is afforded, and the stabilizing structure of the instant invention may further be constructed of readily available materials.

The main object of this invention is to provide a ladder stabilizing structure which will be capable of ready securement to substantially any ladder equipped with tubular rungs.

Another object of this invention is to provide a ladder stabilizing structure constructed in a manner whereby it may be readily folded into a compact state.

Still another important object of this invention is to provide a ladder stabilizing structure that may be readily removed from one ladder and mounted upon another ladder.

A further important object of this invention is to provide a ladder stabilizing structure including means whereby the stabilizing legs thereof may be quickly adjusted in length.

A final object of this invention to be specifically enumerated herein is to provide a ladder stabilizing structure in accordance with the preceding objects and which conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
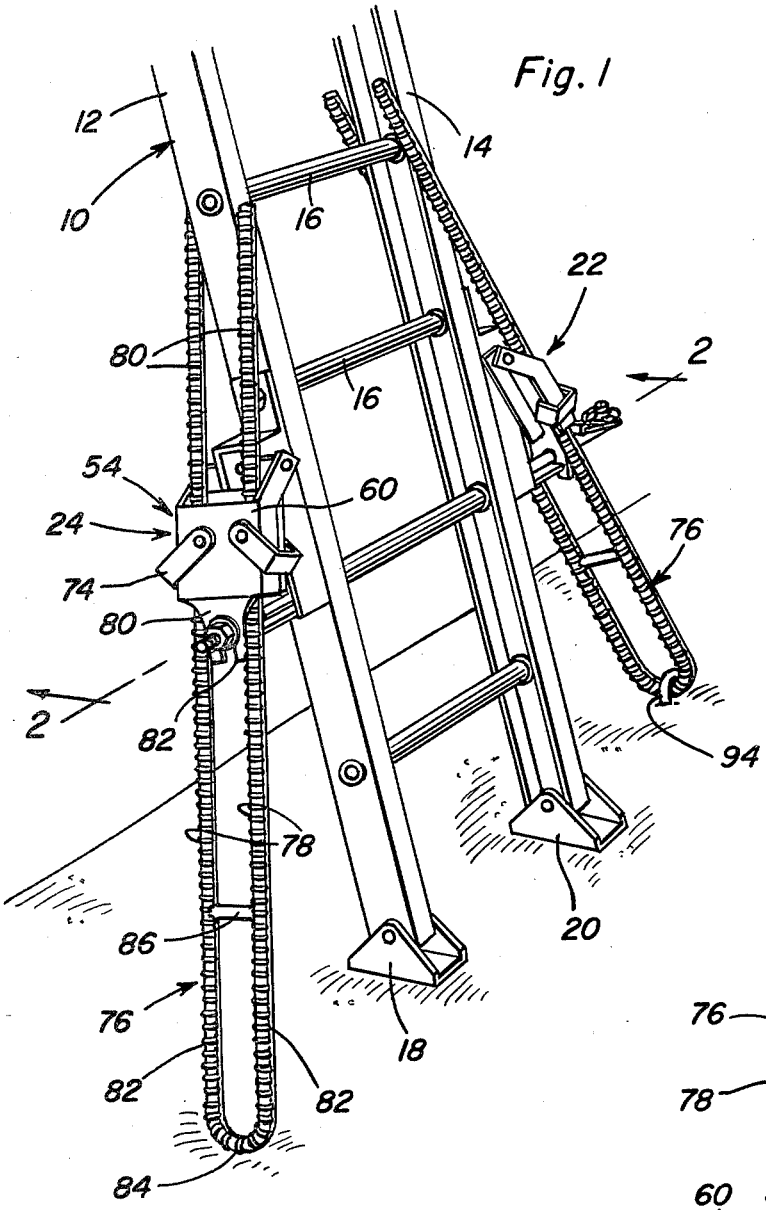
FIG. 1 is a fragmentary perspective view of the lower end of a conventional form of ladder equipped with tubular rungs and with the ladder stabilizing structure of the instant invention operatively associated therewith.
Figure 5:
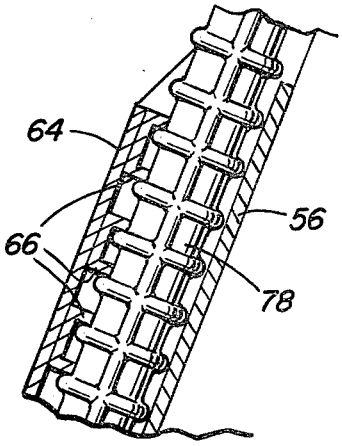
FIG. 5 is a fragmentary vertical sectional view illustrating the manner in which the stabilizing structure may be adjusted in longitudinally extended position.

Referring now more specifically to the drawings, the numeral 10 generally designates a ladder including a pair of channel-shaped opposite side rails 12 and 14 interconnected by means of vertically spaced tubular rungs 16 extending and secured therebetween. The lower ends of the side rails 12 and 14 include pivoted foot portions 18 and 20, as is conventional.

The ladder stabilizing structure of the instant invention is referred to in general by the reference numeral 22 and includes a pair of mounts 24 secured to the outer sides of the side rails 12 and 14 by a pipe 26 received through one rung 16 of the ladder 10 and openings 28 formed in the upper portions of the mounts 24 through which the externally threaded opposite ends 30 of the pipe 26 extend. A pair of threaded nuts 32 are threaded on the opposite ends 30 of the pipe 26 in order to clamp the upper portions of the mounts 24 to the remote sides of the side rails 12 and 14.

The stabilizing structure 22 further includes a longer lower pipe 36 which extends through the rung 16 immediately beneath the rung 16 through which the pipe 26 extends. The lower ends of the mounts 24 include openings 34 through which the opposite ends of the pipe 32 project and the left hand end of the pipe 32, as viewed in FIGS. 1 and 2 of the drawings, is externally threaded as at 36 and has a nut 38 mounted thereon. The right hand end of the pipe 36 includes a locking bale 40 pivotally supported therefrom as at 42 and the bale 40 is equipped with a roller 44 which may be swung downwardly into operative position closely overlying the corresponding end of the pipe 32 or up into an inoperative out of the way position, such as that illustrated in phantom lines in FIG. 2. The bale 40 includes a cross piece 46 over which a pivoted latch member 48 may be swung to maintain the bale and thus the roller 44 in the solid line position thereof illustrated in FIG. 2. The latch member 48 is pivotally supported from the right hand end of the pipe 32 by a pivot fastener 50.

The mounts 24 include support portions referred to in general by the reference numeral 54 and each of the support portions includes a base portion 56 pivotally supported from the corresponding mounts 24 by a pivot fastener 58 and a clamp portion 60 also pivotally supported from the associated mount 24 by means of the corresponding pivot fastener 58. Each clamp portions 60 comprises a channel member having a pair of opposite side flanges 62 interconnected by means of a bight portion 64 and each of the bight portions 64 includes a plurality of transverse channel member 566 secured to the inner surface thereof. The channel members 66 define transversely extending ribs between which transversely extending grooves are defined. Each channel shaped clamp portion 60 includes a pair of rollers 70 journaled therein from pivot pins 72 in spaced relation relative to the flanges 62 thereof and each of the pivot pins 72 has a U-shaped locking clip 74 also pivotally supported therefrom.

An elongated stabilizing support referred to in general by the reference numeral 76 is provided for each support portion 54 and includes a transversely ribbed reinforcing bar bent into U-shape configuration including a pair of arms 78 having a first pair of end portions 80 thereof free of connecting structure extending therebetween and a second pair of end portions 82 thereof interconnected by means of a terminal end U-shaped integral bend 84 and also by a transverse handle member 86 extending and connected therebetween spaced from the bend 84.

Figure 6:
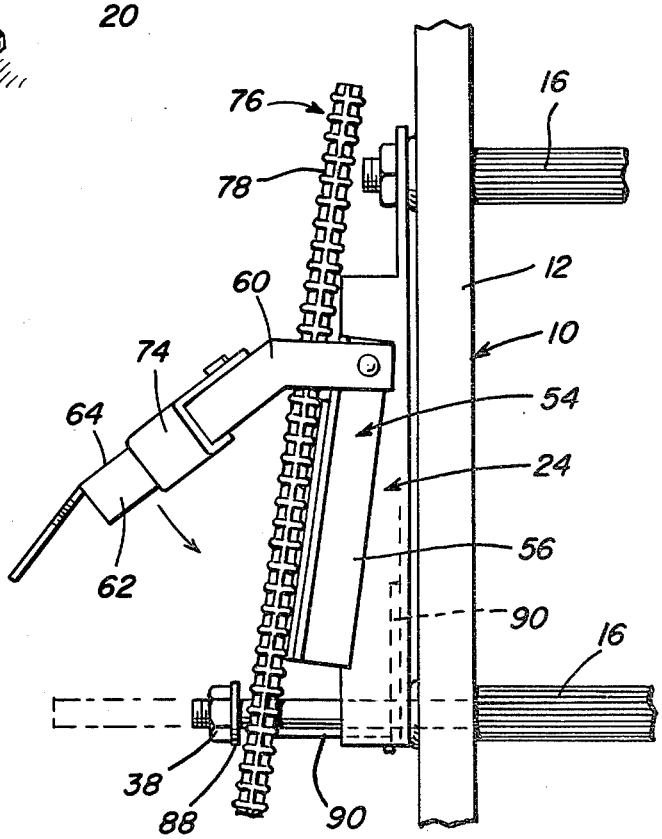
FIG. 6 is a fragmentary elevational view illustrating the manner in which the stabilizing structure may be freed for swinging to a fully collapsed position.
Figure 2:
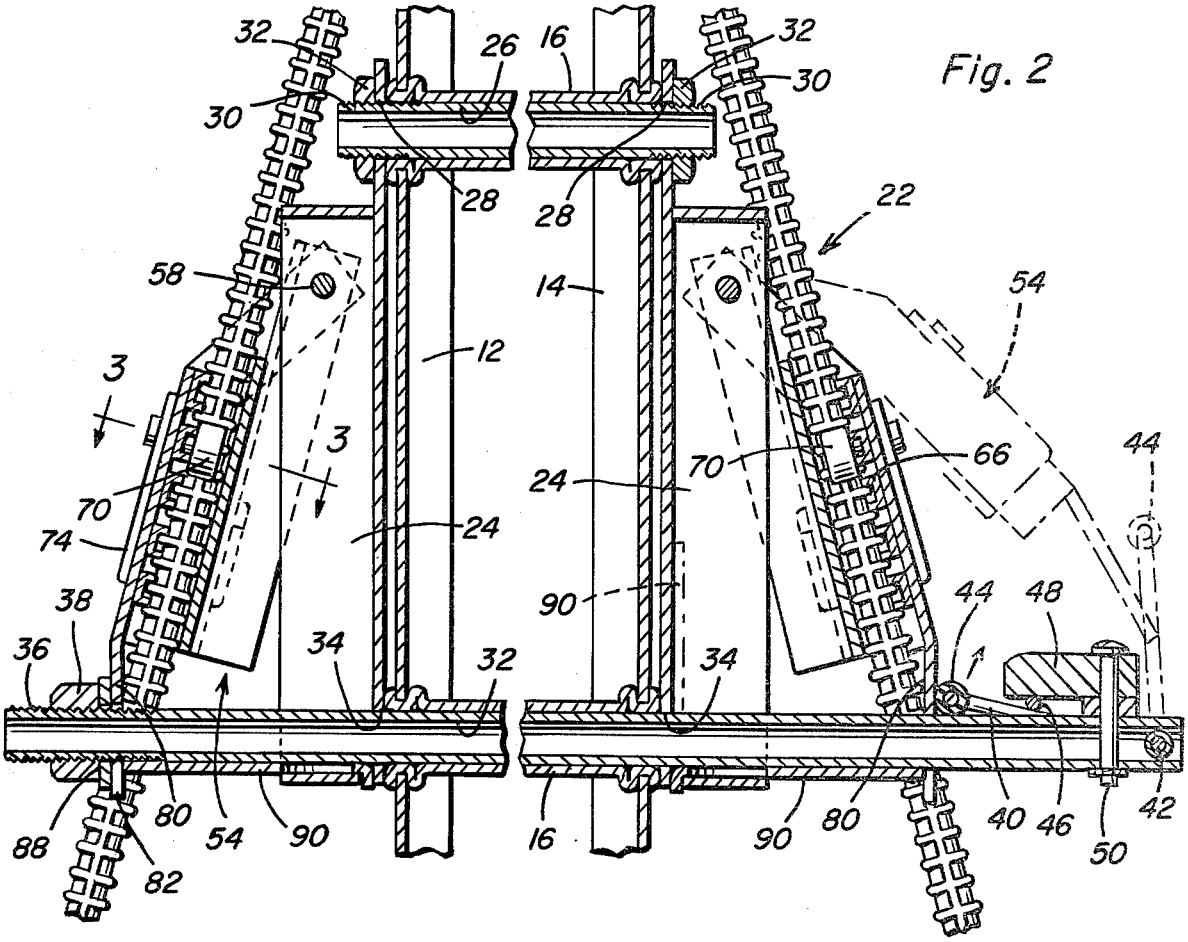
FIG. 2 is an enlarged fragmentary vertical sectional view taken substantially upon the plane indicated by the section line 2—2 of FIG. 1 and with the central portions of the ladder rungs broken away.
Figure 3:
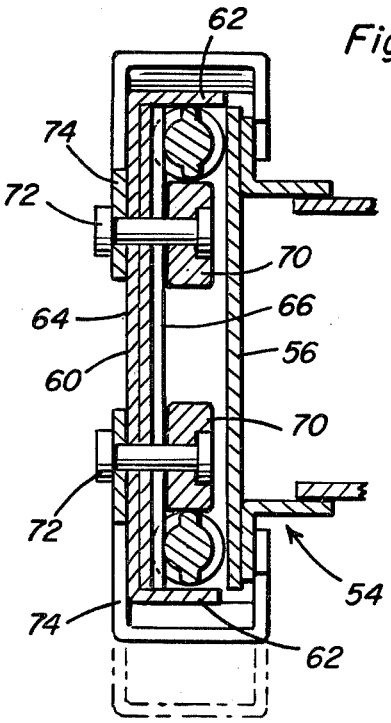
FIG. 3 is an enlarged fragmentary horizontal sectional view taken substantially upon the plane indicated by the section line 3—3 of FIG. 2.
Figure 4:
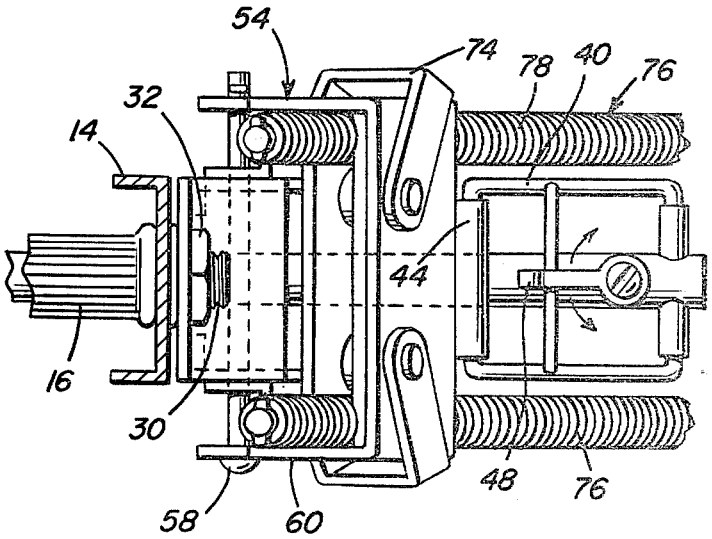
FIG. 4 is a top plan view of the right hand portion of FIG. 2.

The arms 78 are slidably received on the outer sides of the base portion 56 and the clamp portion 60 may be swung into and out of operative position, such as that illustrated in FIGS. 2 and 3 of the drawings, with the arms 78 guidingly received between the rollers 70 and the flanges 62 and the transverse ribs on the arms 78 received within and between the channel members 66 in order to prevent lengthwise shifting of the arms 78 relative to the support portions 54. When the clamp portion 60 is in the operative position thereof illustrated in FIG. 3 of the drawings, the U-shaped locking clips 74 are pivoted into position embracingly engaging remote sides of the clamp portion 60 and base portion 56 whereby the arms 78 will be locked in adjusted shifted positions relative to the support portions 54. However, when the support portions 54 are swung outwardly to the phantom line position thereof illustrated in the right hand portion of FIG. 2 and the solid line position thereof illustrated in FIG. 6, the arms 78 of the stabilizing supports 76 may be readily longitudinally shifted relative to the base portions 56 into the desired extended positions. Thereafter, the clamp portions 60 may be swung from the inoperative position to the operative positions thereof illustrated in FIGS. 2 and 3 and the locking clips 74 may be swung to their operative positions preventing swinging movement of the clamp portions 60 out of their operative positions.

As may be seen from FIGS. 1 and 2 of the drawings, the clamp portions 60 include downwardly projecting portions 80 equipped with downwardly opening notches 82 in which the opposite end portions of the pipe 32 are receivable. The downwardly opening notches 82 seat against the upper surface of the pipe 32 and outward displacement of the left hand depending portion 80 illustrated in FIG. 2 is prevented by the nut 38 and the companion washer 84 on the corresponding end of the pipe 32 while outward swing of the depending portion 80 on the right hand side of FIG. 2 is prevented by the roller 44 on the bale 40 when the latter is in its operative position illustrated in phantom line in FIG. 2. Of course, the latch member 48 maintains the bale 40 in its operative position.

If it becomes necessary to lengthwise adjust the stabilizing support, the latch member 48 is turned to an inoperative position, the bale 40 is swung upwardly and outwardly to an inoperative position and the pipe 32 is shifted to the left as viewed in FIG. 2 of the drawings in order that the nut 38 and companion washer 88 may be displaced sufficiently to the left in order to enable the clamp portion 60 on the left hand side of the ladder 10, after the corresponding clips 74 have been swung to their inoperative positions, to be swung upwardly and outwardly. Then, the left hand stabilizing support 76 may be longitudinally shifted relative to the corresponding base portion 56 to the desired position and then again locked into position by downward swinging movement of the clamp portion 60 to its operative position and subsequent swinging of the corresponding clips 74 to their operative position. Thereafter, the pipe 32 is shifted back to the right and the same adjustment of the right hand stabilizing support 76 may be effected before the bale 40 is again swung to the lowered operative position thereof and locked into position by means of the latch member 48.

Of course, if it is desired to fully collapse the stabilizing supports 76 against the opposite sides of the ladder 10, the bolt 38 and companion washer 88 may be removed and the pipe 32 may be retracted to the right in order that the plate 90 underlying the left hand end of the pipe 32 may be swung upwardly to a position disposed along the bight portion 56. Thereafter, the left hand support portion 54 may be swung to a position closely paralleling the side rail 12. Further, when the pipe 32 is completely withdrawn from the corresponding rail 16, the right hand plate 90 may be swung to the retracted upstanding position thereof illustrated in phantom lines in FIG. 2 after which the right hand stabilizing support 76 may be swung into position closely paralleling the side rail 14 of the ladder the plates 90 including openings 91 therein for subsequently receiving the pipe 32 therethrough.

The stabilizing supports 78 may be readily anchored relative to the surfaces upon which the lower reversely bent end portions 84 thereof rest by utilizing any suitable form of fastener, such as the staple 94 illustrated in FIG. 1, anchoring the lower end of the right hand stabilizing support 76 to the ground upon which the ladder 10 rests.

Figure 7:
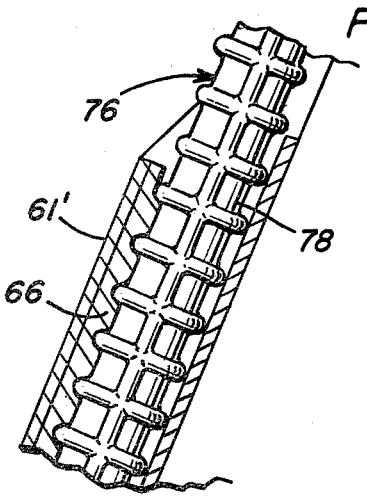
FIG. 7 is a fragmentary vertical sectional view similar to FIG. 5 but illustrating a modified form of adjustment locking structure.

With reference to FIG. 7, there may be seen a modified form of clamp portion 60' including a ribbed insert 61 for interlocking engagement with the associated arms 78 rather than the channel members 66.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an upstanding ladder including opposite side rails interconnected by a plurality of spaced rungs extending and secured therebetween at points spaced therealong, a pair of mounts carried by said opposite side rails, a pair of elongated stabilizing supports each including a pair of generally parallel arms having a first pair of end portions free of connections extending therebetween and connecting means extending between and connecting the second pair of end portions thereof, supporting means supporting said stabilizing supports from said mounts in upwardly convergent positions, with said first pair of end portions uppermost and for lengthwise adjustable shifting of said stabilizing supports relative to said mounts, said first pair of end portions of each of the stabilizing supports, when the latter are in upper adjusted positions thereof, embracingly receiving the corresponding side rail therebetween.

2. The combination of claim 1 wherein said supporting means includes support portions from and relative to which said stabilizing supports are lengthwise adjustably shiftable, said support portions being mounted on said mounts for angular displacement about generally parallel axes disposed at least substantially normal to a plane containing said side rails.

3. The combination of claim 1 wherein said arms include means defining longitudinally spaced transverse ridges thereon, said mounts including releasable ribbed clamp structure for interlocking engagement with said ridges to prevent lengthwise shifting of said arms relative to said mounts.

4. The combination of claim 1 wherein said supporting means includes support portions from and relative to which said stabilizing supports are lengthwise adjustably shiftable, said support portions being mounted on said mounts for angular displacement about generally parallel axes disposed at least substantially normal to a plane containing said side rails, limit means connected between said support portions releasably limiting movement of said support portions, below said axes, toward each other.

5. The combination of claim 4 wherein said limit means also includes means releasably limiting movement of said support portions, below said axes, away from each other.

6. The combination of claim 5 wherein said limit means includes means releasably locking said support portions against angular displacement relative to said mounts.

7. The combination of claim 6 wherein said limit means includes an elongated member extending between lower portions of said support portions below said axes and adapted to extend through a tubular rung of the associated ladder.

8. The combination of claim 1 including a pair of elongated mounting members adapted to extend through adjacent tubular rungs of the associated ladder, said mounts being removably supported from and extending between corresponding end portions of said elongated mounting members.

9. The combination of claim 8 wherein said supporting means includes support portions from and relative to which said stabilizing supports are lengthwise adjustably shiftable, said support portions being mounted on said mounts for angular displacement about generally parallel axes disposed at least substantially normal to a plane containing said side rails.

10. The combination of claim 9 wherein said arms include means defining longitudinally spaced transverse ridges thereon, said mounts including releasable ribbed clamp structure for interlocking engagement with said ridges to prevent lengthwise shifting of said arms relative to said mounts.

11. The combination of claim 9 normal to a plane containing said side rails, limit means connected between said support portions releasably limiting movement of said support portions, below said axes, toward each other.

12. In combination with an upstanding ladder including opposite side rails interconnected by a plurality of spaced rungs extending and secured therebetween at points spaced therealong, a pair of mounts carried by said opposite side rails and a pair of elongated stabilizing supports, supporting means supporting said stabilizing supports from said mounts in upwardly convergent positions and for lengthwise adjustable shifting of said stabilizing supports relative to said mounts, said supporting means including support portions from and relative to which said stabilizing supports are lengthwise adjustably shiftable, said support portions being mounted on said mounts for angular displacement about generally parallel axes at least substantially normal to a plane containing said side rails.

13. The combination of claim 12 wherein limit means connected between said support portions releasably limiting movement of said support portions, below said axes, toward each other.

14. The combination of claim 13 wherein said limit means also includes means releasably limiting movement of said support portions, below said axes, away from each other.

15. The combination of claim 14 wherein said limit means includes means releasably locking said support portions against angular displacement relative to said mounts.

* * * * *